United States Patent [19]

Mauer

[11] Patent Number: 4,907,431

[45] Date of Patent: Mar. 13, 1990

[54] ADJUSTABLE LOCK

[75] Inventor: Guenter Mauer, Heiligenhaus, Fed. Rep. of Germany

[73] Assignee: Mauer GmbH, Heiligenhaus, Fed. Rep. of Germany

[21] Appl. No.: 218,566

[22] Filed: Jul. 13, 1988

[51] Int. Cl.[4] ..... E05B 65/12

[52] U.S. Cl. ..... 70/355; 70/383; 70/384

[58] Field of Search ..... 70/384, 383, 382, 317, 70/316, 315, 355

[56] References Cited

U.S. PATENT DOCUMENTS

| | | | |
|---|---|---|---|
| 1,136,067 | 4/1915 | Watson | 70/383 |
| 3,978,700 | 9/1976 | Glass | 70/384 |
| 4,602,491 | 7/1986 | Mauer | 70/317 |

*Primary Examiner*—Robert L. Wolfe
*Attorney, Agent, or Firm*—Ralf H. Siegemund

[57] ABSTRACT

An adjustable lock has an adjustment slide arranged in the bottom of a key housing, the slide is situated underneath the bolt element and a number of tumbler devices with teeth engage a blade carried by that slide, the improvement of that lock includes a recess and an oblong slot in the bolt element, a first stationay pin mounted to the housing and traversing the oblong slot; a bolt drive lever has its lower end mounted on the pin and is otherwise situated in the recess for translating key motion into a larger latch motion for the bolt, the bolt drive lever having a projection; in addition to a bearing bore, a central part of the bolt driver lever is provided with a key control curve, and the projection on the drive lever engages a U-shaped indent of the bolt, so that the bolt is moved on turning of the drive lever; hence the tumblers are encoded when a key is inserted and turned oppositely following the taking out of the tumblers of said blade, and the key, possibly a new and different key, then re-encodes the tumblers and their alignment.

6 Claims, 1 Drawing Sheet

ADJUSTABLE LOCK

BACKGROUND OF THE INVENTION

The present invention relates to an adjustable lock in a housing and an adjusting slide mounted in the bottom of the housing and disposed under the bolt element, there being a number of tumblers having teeth which engage a blade carried by the adjustment slide.

Adjustable locks particularly for operation by twin bit keys and having a number of tumblers are well known. All these locks require a particular advance motion of the key in order to arrange the tumblers before the bolt is allowed to be moved.

DESCRIPTION OF THE INVENTION

It is an object of the present invention to provide a new and improved lock such that the key advance, either a linear path or a turning angle, is increased so as to improve control action with certainty by means of the key.

In accordance with the preferred embodiment of the present invention, the object is attained in that the latch has an indent in the range of the key path as well as an oblong slot; a stationary pin traverses this oblong slot, that this pin supports the lower end of a bolt drive lever being otherwise situated in the aforementioned manner, which lever in addition to this bearing bore has in its central part a slot or recess which corresponds to the key bit, while this lever has an upper end projection which positively engages a U-shaped part of the aforementioned indent in the bolt for driving the same. Hence, the bolt drive lever is basically a one arm lever being supported in its lower end, and forced through the key bit acting upon it in the center of this lever to realize a 2:1 ratio as between action as imparted and action as obtained. Concerning the adjustment of the lock to a new key, a separate unlocking/latching lever is provided to render the adjustment slide movable (it is stationary on regular key operation). When this slide is unlocked and is in some fashion shifted by the inserted key, a position obtains in which a new (different) key can be inserted; on turning this new key back, a new encoding of the tumblers by this new key obtains, and the slide is re-locked until a new encoding is sought.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding to the detailed description of the drawings, FIG. 1 illustrates a casing or housing 1 of a lock. The principal elements in that housing include a stationary pin 2, and an adjustment slide 3 as well as a microswitch 4. Housing or casing 1 is preferably made by die casting and has upstanding walls 1*a* running all round the perimeter of the housing bottom. Reference numeral 1*b* refers to several reinforcements which provide penetrating apertures 1*c* for receiving fastening screws to fasten the housing to whatever is to be locked (a door, a lid etc.). Reference numeral 1*d* refers to stiffening reinforcements of the housing, reaching to the upper edge of walls 1*a* and they are provided with smaller threaded bores 1*e* which are needed for fastening the cover to the lock housing which cover has been removed.

Figure 1:
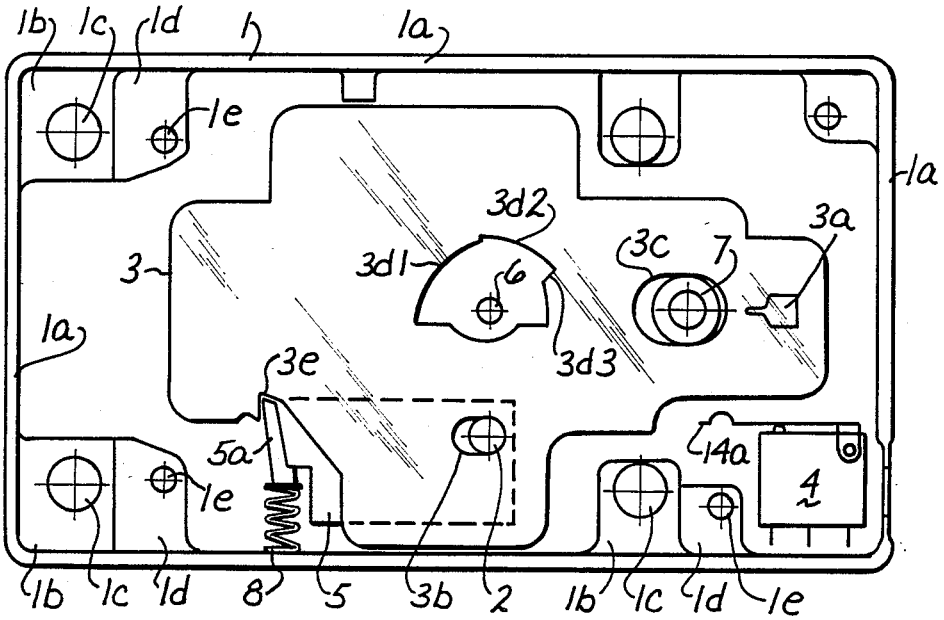
FIG. 1 is a view into a lock, being shown open with removed cover and pertaining to an example of the preferred embodiment of the invention for practicing the best mode thereof.

The stationary mandrel or pin 2 has several functions. It is a bearing pin for mounting a locking lever 5 having a nose 5*a* that reaches into the slide 3. In addition, pin 2 supports the bolt drive lever 10 shown specifically in FIG. 2. Another stationary support pin 6 serves as a key guide pin. The bottom of the housing, moreover, carries a post 7 in which are mounted all tumblers corresponding to FIGS. 3 and 4.

The lock adjustment slide 3 is basically a flat element being mounted in a recess of the bottom of housing 1 such that it can be shifted by a few mm to the right. Slide 3 carries a blade pin 3*a* which extends up to the lock cover and engages the teeth 15*b* of the adjustment tumbler 15, shown in FIG. 4. Oblong slots 3*b* and 3*c* are provided in slide 3 permitting respectively the pin 2 and the post 7 to traverse them. These slots 3*b* and 3*c* participate in guiding the slide 3.

The central portion of the slide 3, actually of the arrangement as a whole, a key control cam is provided having a plurality of sections and cam segments. Two particular circular cam sections 3*d*1 and 3*d*2 are provided in conjunction with a drive nose or projection 3*d*3. Details of this cam assembly will be described below.

In the illustrated position of slide 3, the locking nose 5*a* of a lever 5 is forced by means of a spring 8 into a cut-out 3*e* of the slide 3. This way the slide is locked which means that the tumbler or lock-key association is "frozen". If the locking lever 5 is moved counterclockwise the slide 3 can be placed by means of the key into the right hand adjustment position in which case and position the lock-key selection can be changed. Here then blade 3 releases the tumblers. Locking lever 5 can be actuated from the rear of the lock by means of a pin. This applies for example if a particular lock pertains to safety deposit box then the adjustment of a new key is made possible from the rear of the open door.

Figure 2:
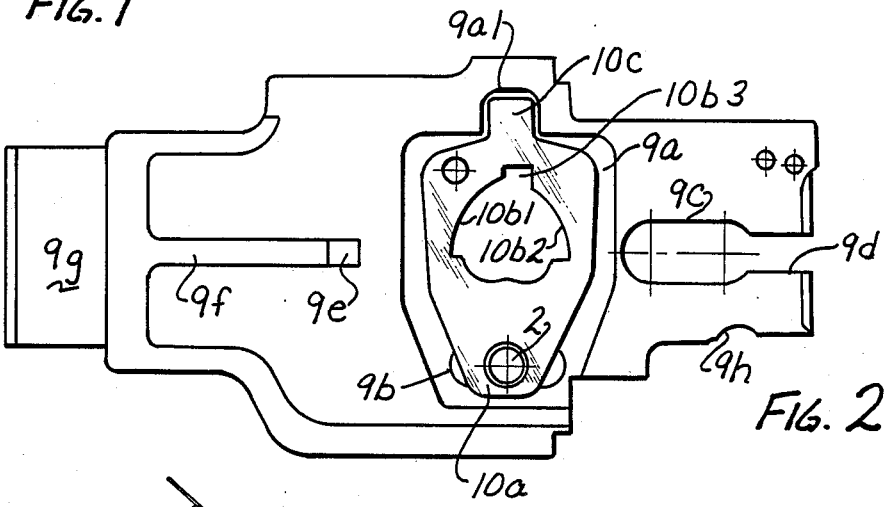
FIG. 2 illustrates a bolt with bolt drive lever used in the lock as shown in FIG. 1.

FIG. 2 illustrates the bolt 9 in top elevation. The bolt 9 is slidably mounted in the housing or casing 1. The bolt has an indent 9*a* in about its middle in which is situated the bolt drive lever 10. That lever has its slower end mounted, journalled and positioned on the stationary pin 2. The upper end of lever 10 is provided with a projection 10*c* inserted in a U-shaped cut-out 9*a*1 of the latch 9 and of the recess 9*a* in particular. Upon pivoting lever 10 to the right its projection 10*c* actually carries along the bolt 9.

The bolt 9 is furthermore provided with an oblong slot 9*b* penetrated by the stationary pin 2. Another oblong slot 9*c* guides the bolt on the stationary post 7 (see FIG. 1). The oblong slot 9*c* merges into a narrower slot 9*d* in which moves the blade 3*a* (see also FIG. 1). A control pin 9*e* is connected to the bolt head 9*g* through a stiffening 9*f*.

The outer contour of the bolt drive 10 is spade like or trapezoidal. The lower end is provided with a bearing bore 10*a* traversed by pin 2. The center of the "spade" is provided with a key controlled curve 10*b*. The upper end of drive 10 is provided with the projection 10*c*. The key control curve 10*b* is essentially comprised of two arc shaped portions 10*b*1 and 10*b*2 as well as an in between; U-shaped contour 10*b*3.

Figure 3:
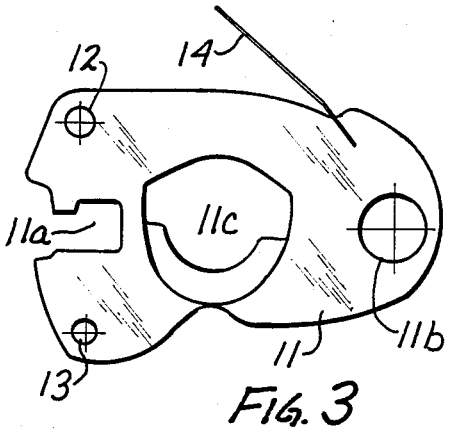
FIG. 3 is a front view of the wing tumbler set that responds to particular coordinated tumblers.

FIG. 3 illustrates a wing-like tumbler 11 which in addition to the pin slot 11*a* is provided with a bearing bore 11*b*. Together with the post 7 bore 11*b* provides a rotational or pivot bearing for the tumbler 11. The key control curve is denoted with reference numeral 11*c*. The wing-like tumbler 11 carries two pins 12 and 13 which reach beyond the adjustment tumblers and thereby limit the angular deflection thereof. A leaf spring 14 bears against the housing wall 1*a* and establishes a definite end position of the tumbler structure when no force is exerted upon them by the key bit.

Figure 4:
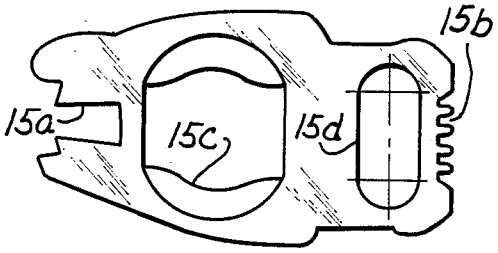
FIG. 4 is a front view of one of several tumblers by means of which the lock is encoded.

FIG. 4 illustrates a change over type tumbler structure 15 which on the left hand side is provided with a control pin slot 15*a* and to the right there is a bearing teeth assembly 15*b* operating on lock adjustment. A controlled recess or indent 15*c* is provided centrally in 15. Between the recess 15*c* and the teeth 15*b* is provided an oblong slot 15*b* which is penetrated by the post 7 (see also FIG. 1).

On assembling one places at first the locking lever 5 and the slide 3 in the appropriate position in housing 1. Then the bolt 9 is shifted into position together with the drive lever 10. Next, the wing hold down and tumbler structure 11 is provided followed by eight tumblers of the type shown in FIG. 4, they may to some extent be provided with leaf springs in order to make sure that they are held in the adjusted position on retraction of the key as will be described.

The lock as described operates as follows. Upon insertion of the key into the lock. The key is held in and by the key guiding pin 6. It is assumed that the lock is locked and the purpose of the insertion of the key is to have the bolt element retracted. The key bits have at first a horizontal orientation i.e. they point in the direction of the bolt axis. Now, as the key is turned clockwise, all tumblers 15 are arranged so that the control pin 9*e* faces slot 11*a*. The latch-lock portion of the key moves at first in and along the curve 10*b*1, without moving the latch drive lever 10. After certain advance and turning angle of about 80 degrees, the key bit hits the contour 10*b*3, and now carries along the lever 10 to the right. The lever 10 will be caused to turn about the pin 2 and this motion is translated into a 2:1 ration motion through the projection 10*c* and is imprted as such on the bolt 9. The bolt is fully retracted whenever the key has turned by 140 degrees. The drive angle amounts to about 50 to 60 degrees. When the lock is opened the key cannot be removed.

On closing the key bit it runs at first on and along the cam surface 10*b*2 until hitting 10*b*3 from the other side. The work stroke begins and is followed by a certain movement to the end as the key bit runs on the curved 10*b*1 and here now all of the tumblers are moved into a locking position.

The latch and locking position is scanned by means of a lever 4*a* pertaining to the microswitch 4. On lock position of the bolt, lever 4*a* drops into an indent 9*h* and thereupon the contacts of the switch 4 are actuated. The closing state can thus be made subject to a remote monitor in a suitable location. Also it is possible to register date and time of the now detected actuation of the key or one may simply tally the number of openings and closures.

On translating the key movement by means of the bolt drive lever produces a very large advance angle of 80 degrees so that even in the case of large tolerances the tumblers are clearly properly arranged before the control pin 9*e* has reached the line slots 15*a* of the tumblers. Conventional keys cover an angle of 60 degrees or less.

Whenever it is desirable to change the key code to a different one it is necessary at first to unlock and to open the door of whatever is being locked by this lock. This requires the old key. At first the lock is opened and gripping if out from behind with one hand one moves the lever 5 that is accessible from the rear, in down direction. The key is turned with the other hand to the 180 degree position (vertical). Thereupon the slide 3 is carried along via the cam surface 3*d*3, and the blade 3*a* recedes from all the tumbler devices 15. In the 180 degree position this key is still the old key, it now is removed and a new key is inserted. As this new key is turned to the left, all those tumbler devices 15 that are being held by the particular pin 9*e* are affected by the new key code. Whenever this procedure is terminated the key bit hits curve 3*d*1 and carries thereafter the slide 3 to the left. The blade 3*a* is moved in all those gaps which match the new key encoding whereupon the nose 9*a* of the lever 9 latches a new. At the same time the new key is actually turned counterclockwise to the left; the bolt is thus advanced, the lock is locked, and the zero angle position is attained for the key so that the key can be removed.

In deviating from the illustrated device it is possible e.g. to cause the lever 5 to be actuated through another key provided for the purpose and being inserted from the rear. Alternatively the lever 5 with its nose 5*a* may be replaced by a latch spring. That spring requires a stronger torque to be applied to the double bit key. It is necessary to shift the key into 180 degrees position without requiring opening of the door and still the key can be removed and replaced by different ones. However, the particular change over procedure described first has the advantage that the slide 3 is held positively in its latching position and cannot be manipulated in any kind of pushing or the like.

The lock as described is simple to adjust and therefore can be used e.g. whenever changes are frequently required. In the case of different "shifts", different people are required to have access and here a rather easy change over and adjustment is possible, both necessary and easily. Particular fields of application are hotels and related services where personnel often changes and keys and locks for safety deposit boxes or the like have to be easily adjusted. The invention has been explained above with reference to double bit key kind of lock but other kinds can be used, single bit closing devices or the like.

The invention is not limited to the embodiments described above but all changes and modifications thereof, not constituting departures from the spirit and scope of the invention, are intended to be included.

I claim:

1. Adjustable lock having an adjustment slide arranged in the bottom of a key housing, the slide being situated underneath the bolt element there being a number of tumbler devices with teeth which engage a blade carried by the above mentioned slide, the improvement comprising:

the bolt element being provided with a recess and an oblong slot;

a first stationary pin being mounted to the housing and traversing said oblong slot;

a bolt drive lever having its lower end mounted on said pin and being otherwise situated in said recess for translating key motion into a larger latch motion for the bolt, the bolt drive lever having a projection;

in addition to a bearing bore, a central part of the bolt drive lever is provided with a key control curve, the projection is provided on the drive lever which engages a U-shaped indent of said bolt, so that the bolt is moved on turning of the drive lever.

2. Lock as in claim 1, said lever providing a lever ratio of 2:1 as far as translating key motion into latch motion for the bolt is concerned.

3. Lock as in claim 1, said key control curve in and of said drive lever having a plurality of arc-shaped sections with an in-between U-shaped contour such that upon unlocking a large advancing angle obtains in conjunction with a relatively small drive angle thereafter while upon locking there is a small drive angle followed by a large follow-up angle to set the tumbler into a locking position.

4. Lock as in claim 1 the adjustment slide being secured by resiliently biased locking lever being moved from the rear of the lock.

5. Lock as in claim 1, said adjustment slide being held by a resilient latch exerting a torque to be overcome by a turned key.

6. Adjustable latch having a bolt element and a plurality of tumbler devices with teeth which engage a blade, the blade being mounted on an adjustment slide, the latch provided for cooperation with a key, the improvement comprising:

lever means for locking and unlocking said slide and for increasing a locking path for the bolt element over and beyond a movement and displacement path by the key;

the key when inserted for unlocked slide permitting, on turning, the slide to be moved in a particular direction, for taking the tumblers out of the blade, the tumblers being encoded when a key being inserted is turned oppositely following the said taking out of the tumblers of said blade, the key, possibly a new and different key, then re-encoding the tumblers and their alignment; and the lever means re-locking the slide as the blade re-engages the tumblers.

* * * * *